US007639132B2

(12) United States Patent
Montague

(10) Patent No.: US 7,639,132 B2
(45) Date of Patent: Dec. 29, 2009

(54) SECURED AND ALARMED WINDOW AND ENTRY WAY

(76) Inventor: Marybeth W. Montague, 4615 N. 22nd St., #112, Phoenix, AZ (US) 85016

( * ) Notice: Subject to any disclaimer, the term of this patent is extended or adjusted under 35 U.S.C. 154(b) by 0 days.

(21) Appl. No.: 12/176,894

(22) Filed: Jul. 21, 2008

(65) Prior Publication Data

US 2008/0284596 A1 Nov. 20, 2008

Related U.S. Application Data

(63) Continuation-in-part of application No. 11/553,366, filed on Oct. 26, 2006, now Pat. No. 7,612,667.

(51) Int. Cl.
*G08B 13/08* (2006.01)

(52) U.S. Cl. ..... 340/545.1

(58) Field of Classification Search ..... 340/545.7, 340/545.8, 550, 541, 545.1; 160/10
See application file for complete search history.

(56) References Cited

U.S. PATENT DOCUMENTS 5,056,262 A * 10/1991 Schweiss et al. ..... 49/56
2002/0167403 A1* 11/2002 Colmenarez et al. ..... 340/541
2003/0164764 A1* 9/2003 Lyons et al. ..... 340/541
2003/0189485 A1* 10/2003 Smith ..... 340/540
2005/0030179 A1* 2/2005 Script et al. ..... 340/545.1

* cited by examiner

*Primary Examiner*—Phung Nguyen
(74) *Attorney, Agent, or Firm*—Parsons & Goltry; Michael W. Goltry; Robert A. Parsons

(57) ABSTRACT

A screen unit has opposed first and second sides and includes a robust mesh having a perimeter, and a frame engaging the perimeter of the robust mesh supporting and preventing relative movement between the frame and the mesh. A security device, formed in the frame, includes sensor apparatus to detect unauthorized tampering of the screen unit that is operatively coupled to a camera apparatus, visual alarm apparatus, and audible alarm apparatus. In response to the sensor apparatus detecting unauthorized tampering of the screen unit, the camera apparatus to collect visual imagery from each of the first and second sides of the screen unit, the visual alarm to issue visual alarm stimulus on each of the first and second sides of the screen unit, and the audible alarm apparatus to issue audible alarm stimulus on each of the first and second sides of the screen unit.

8 Claims, 11 Drawing Sheets

SECURED AND ALARMED WINDOW AND ENTRY WAY

FIELD OF THE INVENTION

The present invention relates to anti-intrusion entryways for dwellings and, more particularly, to security and alarm apparatus to detect and deter unauthorized intrusion and tampering.

BACKGROUND OF THE INVENTION

Most screens used with doors at entryways and in windows in a house or apartment are constructed of relatively easily penetrable plastic, nylon, or metal mesh material. Despite any lock that may be used in conjunction with the screen frame and the door jam or window casing, an intruder can easily remove the screen, or cut or otherwise cause an opening in the screen material, to gain entry. U.S. Pat. No. 6,998,981 discloses a secure screen formed of a robust metal mesh and locking devices that interconnect the screen frame with the surrounding door frame or window casing. The robust metal mesh inhibits intrusion therethrough except for the most determined intruder. Moreover, the locks between the screen frame and the door frame or window casing serve in the conventional manner to prevent opening of the screen.

SUMMARY OF THE INVENTION

The present invention is directed to a screen for a door or a window having a robust mesh that is not easily cut or otherwise compromised to permit an intruder passage therethrough. Several locks may be employed to lockingly secure the screen door with its frame. The screen and its frame may be armed to provide a local or remote audible and/or visually perceivable indication of unauthorized tampering or intrusion. A camera may be triggered upon intrusion to provide photographic evidence of the intruder. Such camera may use conventional film or may be a digital camera that records the image in a memory or in real time. To accommodate entry and exit of pets, an appropriately sized hinged door may be formed in the screen door. To prevent human intrusion through the pet door, it may include a magnetically actuated, infrared frequency actuated, radio frequency actuated or non-audible frequency actuated locking element. Upon the approach of a pet, a magnet or a suitable transmitter secured to the pet's collar provides the requisite signal to the lock to open the lock and permit passage of the pet through the pet door.

It is therefore a primary object of the present invention to provide a screen to prevent tampering or unauthorized intrusion through a door or a window into a dwelling without setting off one or more alarms.

Another object of the present invention is to provide a screen having any of several selectable alarm systems for indicating the presence of an intruder or tampering by an unauthorized person.

Yet another object of the present in invention is to provide a visually perceivable image of an unauthorized intruder entering through or tampering with a screen.

A further object of the present invention is to provide a secure screen door that accommodates passage of pets therethrough without compromising the security of the screen door.

Yet a further object of the present invention is to provide a pet door for use in conjunction with a secure screen door having a locking mechanism releasable by proximity of a pet.

A still further object of the present invention is to provide a method for preventing unauthorized intrusion through a secure screen door while accommodating day-to-day activities and including the passage of pets therethrough.

According to the principle of the invention, a screen unit has opposed first and second sides and consists of a robust mesh having a perimeter, and a frame engaging the perimeter of the robust mesh supporting and preventing relative movement between the frame and the mesh. A security device is formed in the frame. The security device includes camera apparatus to take visual imagery from each of the first and second sides of the screen unit, and sensor apparatus to detect unauthorized tampering of the screen unit operatively coupled to the camera apparatus. In response to the sensor apparatus detecting unauthorized tampering of the screen unit the camera apparatus to collect visual imagery from each of the first and second sides of the screen unit. The security device can be remotely coupled to a camera, which is triggered by a signal sent to the camera in response to the sensor apparatus detecting unauthorized tampering of the screen unit to take visual or photographic imagery of a selected venue. In a further aspect, the security device includes visual alarm apparatus to issue visual alarm stimulus on each of the first and second sides of the screen unit, and the sensor apparatus operatively coupled to the visual alarm apparatus, whereby in response to the sensor apparatus detecting unauthorized tampering of the screen unit the visual alarm to issue visual alarm stimulus on each of the first and second sides of the screen unit. In yet a further aspect, the security device includes an audible alarm apparatus to issue audible alarm stimulus on each of the first and second sides of the screen unit, and the sensor apparatus operatively coupled to the audible alarm apparatus, whereby in response to the sensor apparatus detecting unauthorized tampering of the screen unit the audible alarm apparatus to issue audible alarm stimulus on each of the first and second sides of the screen unit. The visual imagery is photographic imagery. The photographic imagery is a first photographic image taken by the camera apparatus from the first side of the screen unit, and a second photographic image taken by the camera apparatus from the second side of the screen unit. The first and second photographic images are situated side-by-side in a photographic document in a preferred embodiment. The security device is coupled in signal communication to a device over a wireless network, and the security device to issue a message, containing the photographic document, to the device over the wireless network. The security device is formed with a first switch movable between first and second positions to activate and deactivate the camera apparatus, a second switch to activate and deactivate the visual alarm apparatus, and a third switch to activate and deactivate the audible alarm apparatus. The security device also includes a fourth switch to activate and deactivate the first, second, and third switches. Preferably, the first, second, third, and fourth switches are formed along one of the first and second sides of the screen unit.

According to the principle of the invention, a screen unit has opposed first and second sides and consists of a robust mesh having a perimeter, and a frame engaging the perimeter of the robust mesh supporting and preventing relative movement between the frame and the mesh. A security device, formed in the frame, has a third side formed along the first side of the screen unit and a fourth side formed along the second side of the screen unit and further includes a camera apparatus to take visual imagery from each of the third and fourth sides of the security device, and sensor apparatus to detect unauthorized tampering of the screen unit operatively coupled to the camera apparatus. In response to the sensor apparatus detecting unauthorized tampering of the screen unit the camera apparatus to collect visual imagery from each of the third and fourth sides of the screen unit. In another embodiment, the security device includes visual alarm apparatus to issue visual alarm stimulus on each of the third and fourth sides of the security device, and the sensor apparatus operatively coupled to the visual alarm apparatus, whereby in response to the sensor apparatus detecting unauthorized tampering of the screen unit the visual alarm to issue visual alarm stimulus on each of the third and fourth sides of the security device. In another embodiment, the security device further includes an audible alarm apparatus to issue audible alarm stimulus on each of the third and fourth sides of the security device, and the sensor apparatus operatively coupled to the audible alarm apparatus, whereby in response to the sensor apparatus detecting unauthorized tampering of the screen unit the audible alarm apparatus to issue audible alarm stimulus on each of the third and fourth sides of the security device. The visual imagery is photographic imagery. The photographic imagery includes a first photographic image taken by the camera apparatus from the first side of the screen unit, and a second photographic image taken by the camera apparatus from the second side of the screen unit. The first and second photographic images are situated side-by-side in a photographic document. The security device is coupled in signal communication to a device over a wireless network, and the security device to issue a message, containing the photographic document, to the device over the wireless network. The security device is formed with a first switch movable between first and second positions to activate and deactivate the camera apparatus, a second switch to activate and deactivate the visual alarm apparatus, and a third switch to activate and deactivate the audible alarm apparatus. The security device further includes a fourth switch to activate and deactivate the first, second, and third switches. The first, second, third, and fourth switches are formed along one of the third and fourth sides of the security device.

These and other aspects of the present invention will become apparent to those skilled in the art as the description thereof proceeds.

BRIEF DESCRIPTION OF THE DRAWINGS

Referring to the drawings.

DETAILED DESCRIPTION OF PREFERRED EMBODIMENTS

Figure 1:
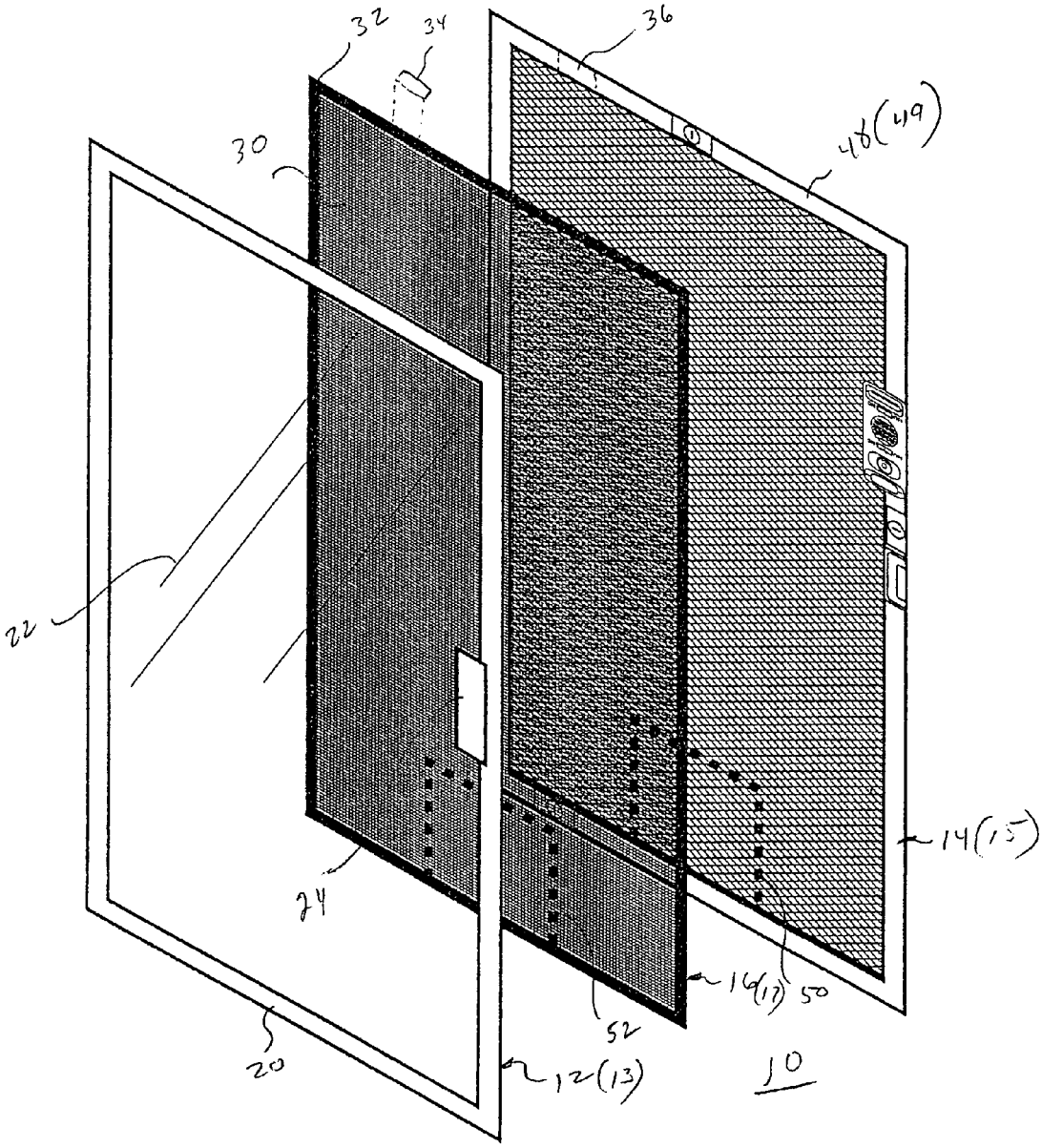
FIG. 1 is a is an exploded view illustrating a conventional sliding glass door, a magnetically attachable insect screen and a secure screen door, this figure can also be construed to depict a window having the same components.

Turning now to the drawings, in which like reference characters indicate corresponding elements throughout the several views, attention is first directed to FIG. 1 in which there is seen an exploded view of a door unit 10 particularly suited as a patio door. It includes a conventional glass door 12, a secure screen door 14 embodying features of the present invention and a detachably attached insect screen 16. Door unit 10 may be incorporated as part of a patio door or entry point wherein a glass door is preferred to provide transmission of light therethrough and yet protect against the elements. Alternatively, it can be used as a front or a back door wherein the glass door would be replaced by a wooden or metal door. The main purpose of screen door 14 is that of preventing unauthorized intrusion at an entry point primarily when the glass door is open and details of the screen door will be described below. The primary purpose of insect screen 16 is to provide a fine mesh to prevent intrusion of insects, debris and the like when the glass door is open. It is to be understood that FIG. 1 and the related figures are also representative of a window having a sliding glass window 13, having an insect screen 17 and a secure screen window 15 with a frame 49.

Glass door 12 includes a frame 20 which may have rollers for sliding movement, as is conventional for a patio door. The frame surrounds a glass panel 22. A manually operated latch 24 is used in the conventional manner to lock and unlock the glass door. It may include a key operated lock or simply a sliding lock, as is conventional. Insect screen 16 includes a screen 30 of a mesh sufficiently fine to prevent passage of insects therethrough. Additionally, it will prevent passage of blow debris. A border 32, which may be rigid or flexible, surrounds and retains insect screen 30. Preferably, border 32 is of magnetic material for detachably attaching the insect screen to the frame of screen door 14. Necessarily, the frame of the screen door must be of magnetically responsive material. Alternatively, border 32 may include one or more magnets as representatively identified by numeral 34 spaced along border 32 for magnetic cooperation with either the frame of screen door 14 or magnetically responsive strips, representatively identified by numeral 36, spaced along the frame of the screen door commensurate with the spacing of magnets 34.

Figure 2:
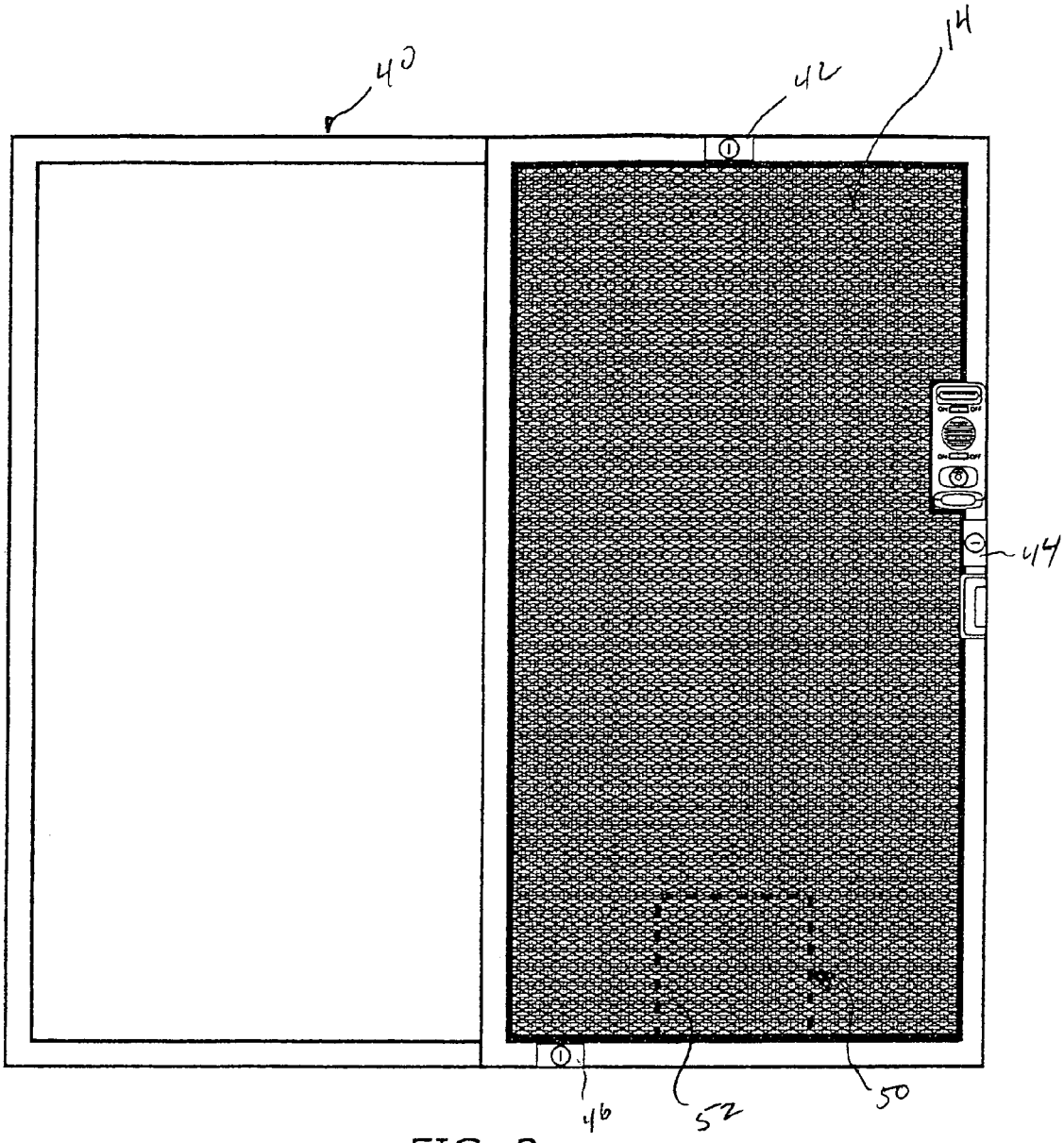
FIG. 2 illustrates installation of the present invention within a conventional door frame.

For purposes of clarity, only screen door 14 is shown in FIG. 2 disposed in door frame 40. As an option, a pet door 50 may be formed in screen door 14 to permit passage of a pet therethrough. Similarly, insect screen 16, if used, would have an opening 52 commensurate with the size and location of pet door 50. In FIGS. 1 and 2, both the pet door and the opening are shown in dashed lines.

Referring jointly to FIGS. 1 and 2, further details of screen door 14 will be described. A door frame 40 of the conventional type slidably supports unit 10 in the conventional manner. Necessarily, it includes latching elements for cooperation with latch 24 on glass door 12. Screen door 14 includes a plurality of locks, of which locks 42, 44, and 46 are shown disposed in frame 48. It is to be understood that the fourth side of the frame may also include a lock and additional locks may be employed spaced at selected locations along the frame.

Figure 3:
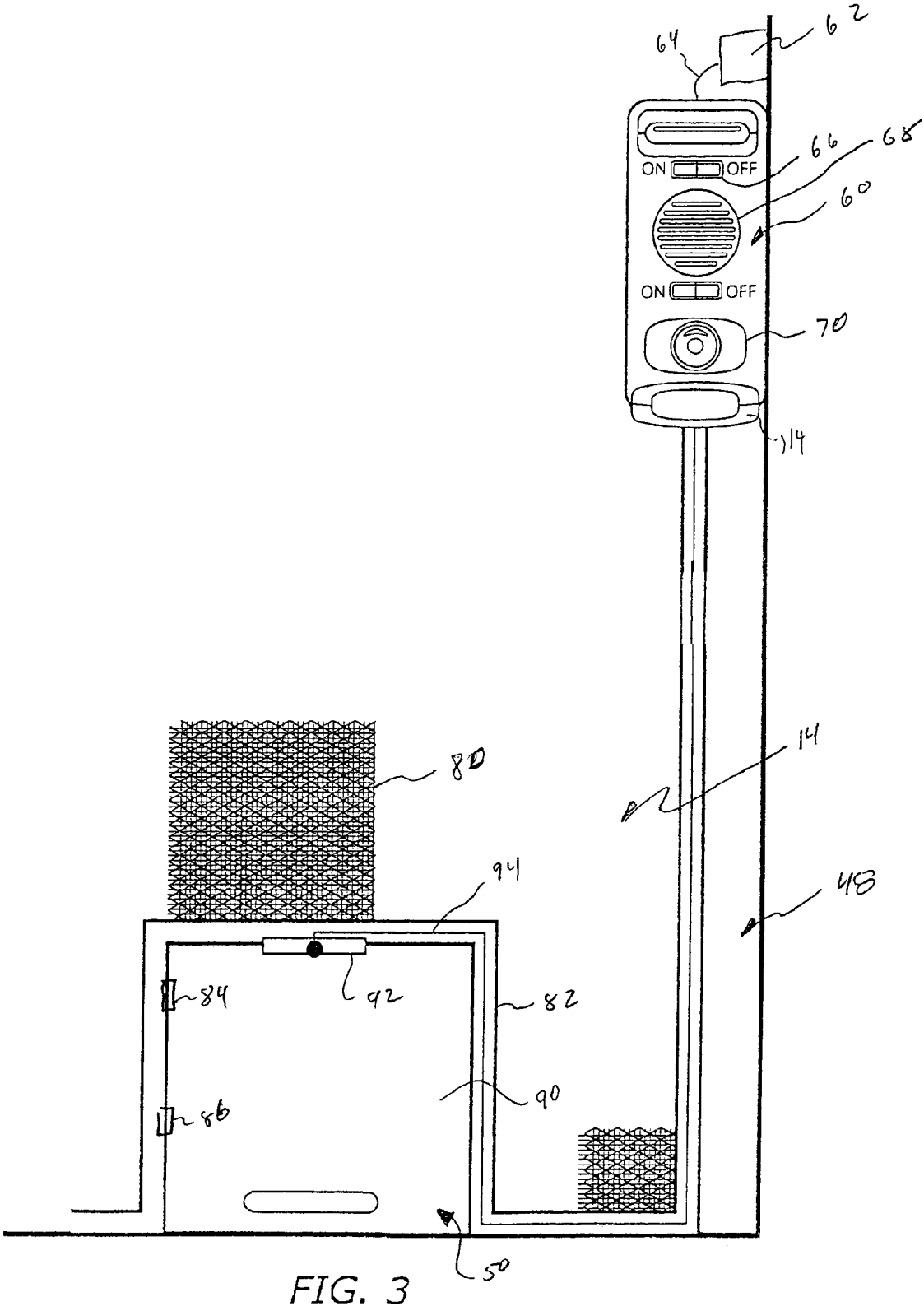
FIG. 3 illustrates in part, a pet door useable in conjunction with the present invention.
Figure 4:
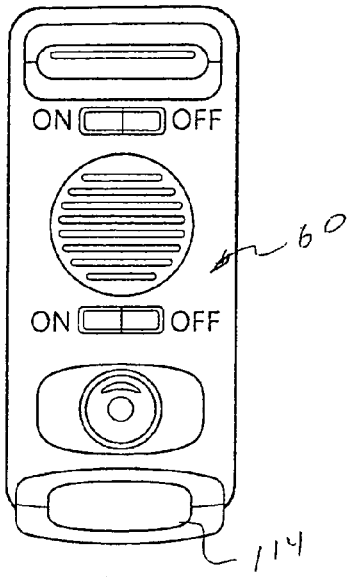
FIG. 4 illustrates a control unit for arming the screen door and for generating an alarm.

Details of the security feature of the present invention will be described with joint reference to FIGS. 1, 2, and 3. A control unit 60 may be mounted on screen door 14 or screen window 15 or other location to control activation and deactivation of various sensors and sensing elements to generate an alarm signal. A plurality of sensors, of which only sensor 62 is shown in FIG. 3, are used to sense unauthorized tampering or movement of the screen door (screen window) that would be reflective of tampering. Each of these sensors may be of the motion detection type, or contact type. Alternatively, they may be of the type that breaks a circuit upon movement of the screen door. Other sensors, including magnetic types, or contact types, for generating a signal upon disturbance of the screen door may be used. All of such sensors are readily commercially available. Each of sensors 62 may be hard wired to control unit 60, as represented by conductor 64. If desired, the sensor can be of the type that generates a signal upon cutting or breaking conductor 64. Alternatively, each of the sensors may emit a low power radio frequency (RF) or infrared (IR) frequency signal upon activation, which signal is sensed by a receiver in the control unit. Activation and deactivation of sensors 62 may be accomplished by an on/off switch 66. Upon activation of a sensor due to unauthorized movement (or tampering) of the screen door (screen window 15), an audible or inaudible alarm may activate a speaker, as represented by apertured cover 68 protecting a loud speaker, activate one or more lights, or transmit a signal to a remote receiver. To provide an indication of the identity of an intruder, a camera 70 may be incorporated in the control unit or at another location. This camera, whether film or digital, would be turned on to obtain an image of the intruder upon activation of one of sensors 62. It is to be understood that in addition to these indicators of the presence of an intruder, control unit 60 may be connected to a telephone system to provide an emergency call to a local police station or to a security company to raise an alarm of an unauthorized intrusion or tampering. The signal transmitted by the alarm may include an identifier to identity the location of tampering or intrusion.

As shown in more detail in FIG. 3, the screen door is formed of a robust mesh 80 of expanded metal to provide air flow therethrough and yet serve as a significant deterrent to tampering or intrusion. Further details of this mesh is described in U.S. Pat. No. 6,998,981, which patent is incorporated by reference herein. If a pet door 50 is incorporated, as shown in FIG. 3, mesh 80 would necessarily surround frame 82 of the pet door.

Referencing jointly to FIGS. 3, 5, 7, and 8, further details of the pet door and its operation will be described. The pet door includes a panel 90 hingedly attached to frame 82 such as by hinges 84, 86. It is to be understood that the pet door may be relatively rigid or of robust but flexible material, such as a rubber or plastic mat material. Panel 90 is lockingly engaged with frame 82, as representatively illustrated by lock 92. In the event this lock is not released, as will be described below, and panel 90 is forced open, a signal will be generated by lock 92, which signal may be of the make or break type of mechanism (such as a magnetic switch, mercury switch or mechanical switch), via conductor 94 to control unit 60. The signal will set off the control unit to provide an alarm. It is to be understood that the depicted locations of hinges 84, 86, and lock 92 are representative and may be changed. If desired, lock 92 can be wireless coupled to control unit 60 and designed to generate and send a signal to control unit 60 in response to a cutting or breaking of conductor 94.

Figure 5:
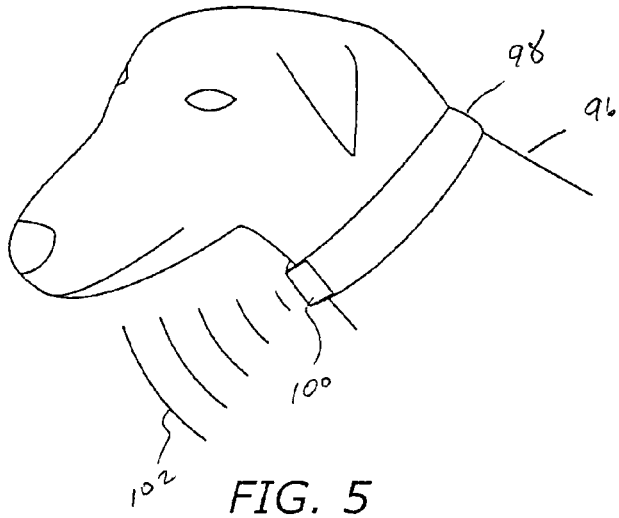
FIG. 5 illustrates a pet having a collar mounted magnet or transmitter for releasing the lock on a pet door.

Release of lock 92 securing panel 90 on pet door 50 may be accomplished by the pet. As shown in FIG. 5, a pet, such as dog 96 named Bear, is provided with a collar 98 which supports a signal generating element, such as a low power radio frequency (RF) or infrared (IR) transmitter 100. The transmitted signal, as represented by lines 102 is sensed by lock 92. Upon such sensing, the lock will automatically unlock and permit pivotal movement of panel 90 to permit the pet passage through pet door 50. Necessarily, the power of transmitter 100 must be very low to prevent unlocking of lock 92 unless the pet is relatively close. Alternatively, collar 98 may include a magnet 104 as the signal generating element to crate a magnetic field in proximity to lock 92 when the pet is close by. The magnetic field is sensed by lock 92 and the lock becomes unlocked upon such sensing. In a third embodiment, collar 98 may included a generator 106 for generating a signal above the audible range for both humans and pets so as not to be disturbing to either humans or pets. This signal may be sensed by lock 92 and upon such sensing the lock would unlock. Necessarily, the volume of the signal must be relatively low to prevent unlocking of lock 92 except when the pet is in close proximity to pet door 50.

Figure 6:
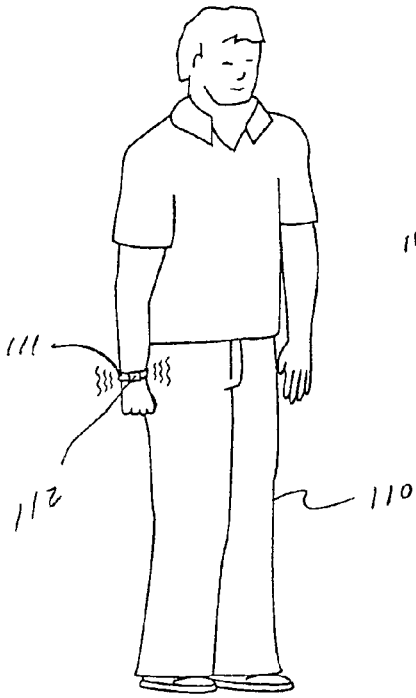
FIG. 6 illustrates a person having a wrist mounted receiver to provide an indication of potential tampering or intrusion by an unauthorized person.
Figure 7:
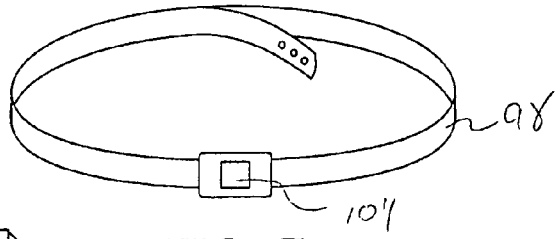
FIGS. 7 and 8 illustrate embodiments of pet collars supporting either a magnet or a transmitter for unlocking a pet door.
Figure 10:
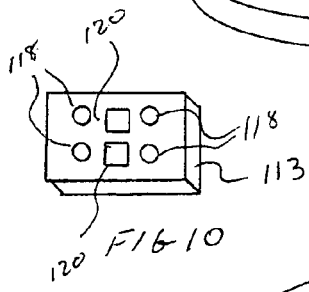
FIG. 10 illustrates a unit to provide indicia of the location activating an alarm.
Figure 8:
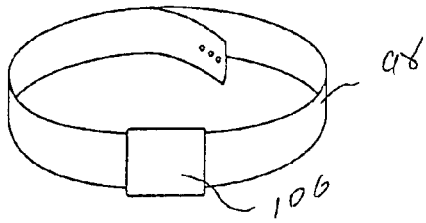

As shown in FIG. 6, an authorized person 110 may carry a receiver 112 for receiving a signal, which receiver may be worn as a wrist band 111. Receiver 112 may be a radio frequency receiver, an infrared frequency receiver, or a receiver for an inaudible sound. Additionally, a unit 113, as shown in FIG. 10, may be incorporated to identify the location of the signal transmitted. This unit may include visually perceivable indicia 118 or audible generators 120 identifying the location of the door or window subjected to tampering or intrusion.

Figure 9:
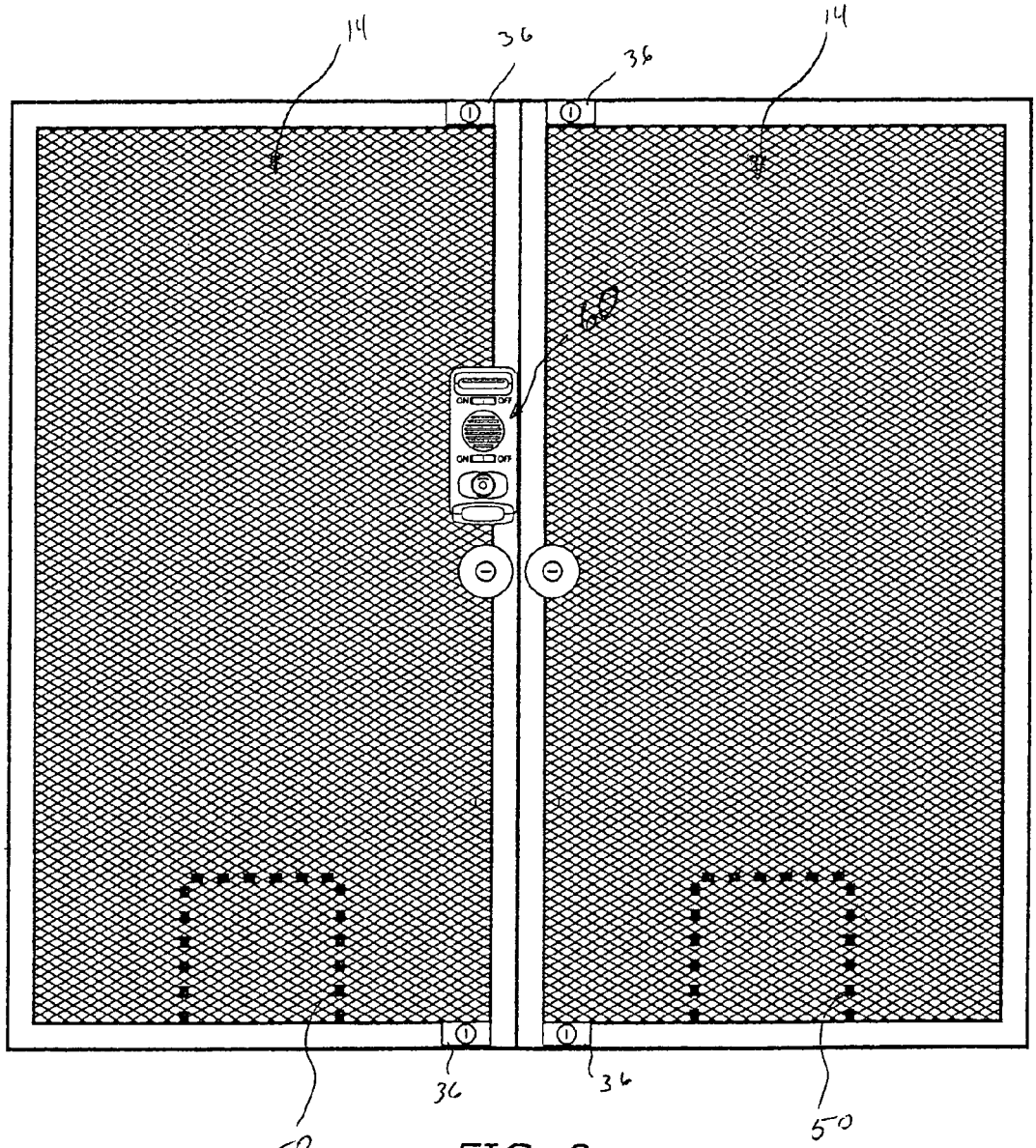
FIG. 9 illustrates use of the present invention as representative French doors.

Referring to FIG. 9, there is shown a pair of screen doors 14 mounted in the manner of French doors. One or both of the screen doors may include a pet door 50, as representatively illustrated in dashed lines. All of the other features described above with respect to FIGS. 1-8 may be incorporated in the screen doors shown in FIG. 9.

Figure 11:
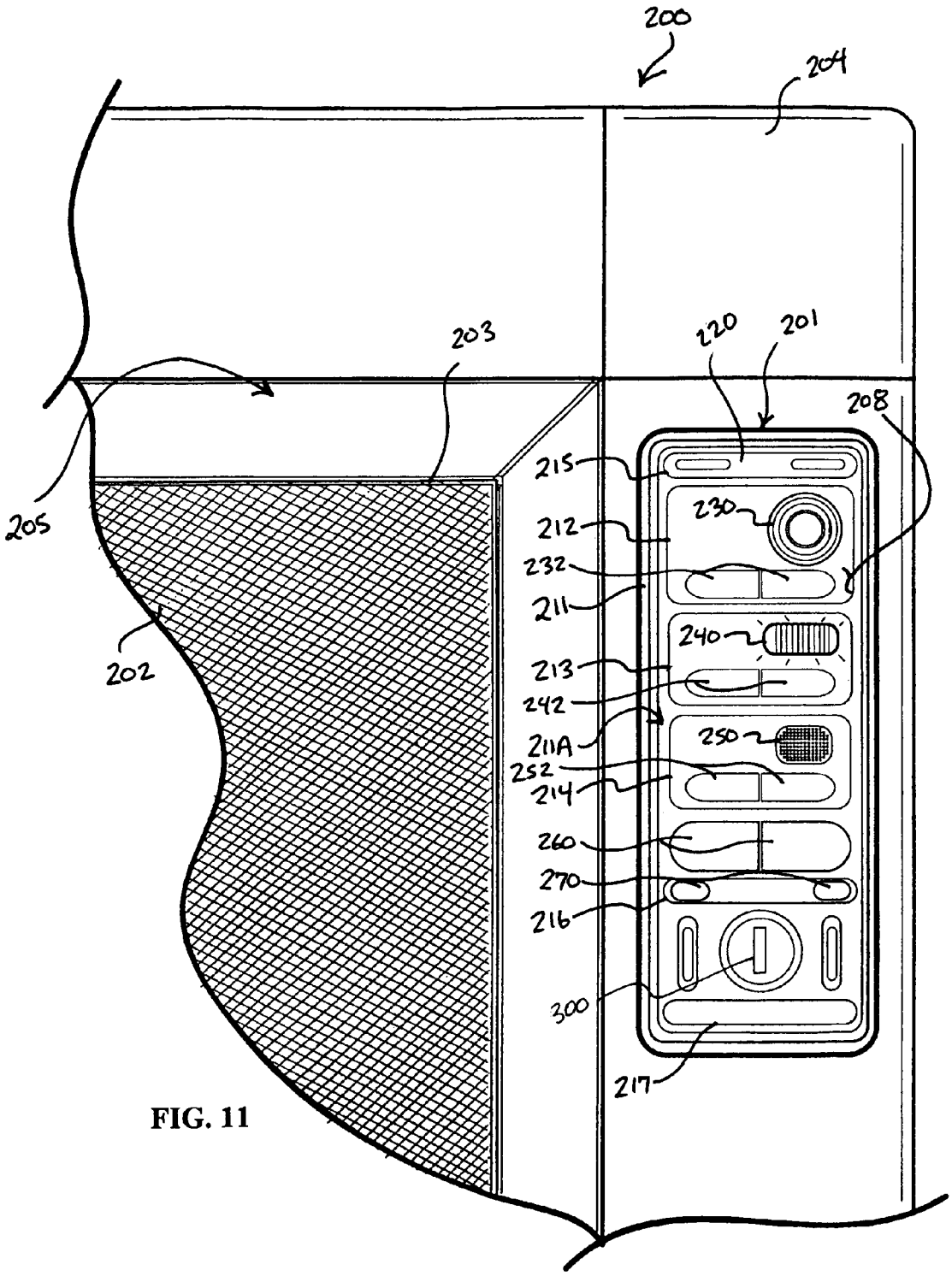
FIG. 11 illustrates a fragmented, front elevational view of a screen unit formed with a security device, constructed and arranged in accordance with the principle of the invention.
Figure 16:
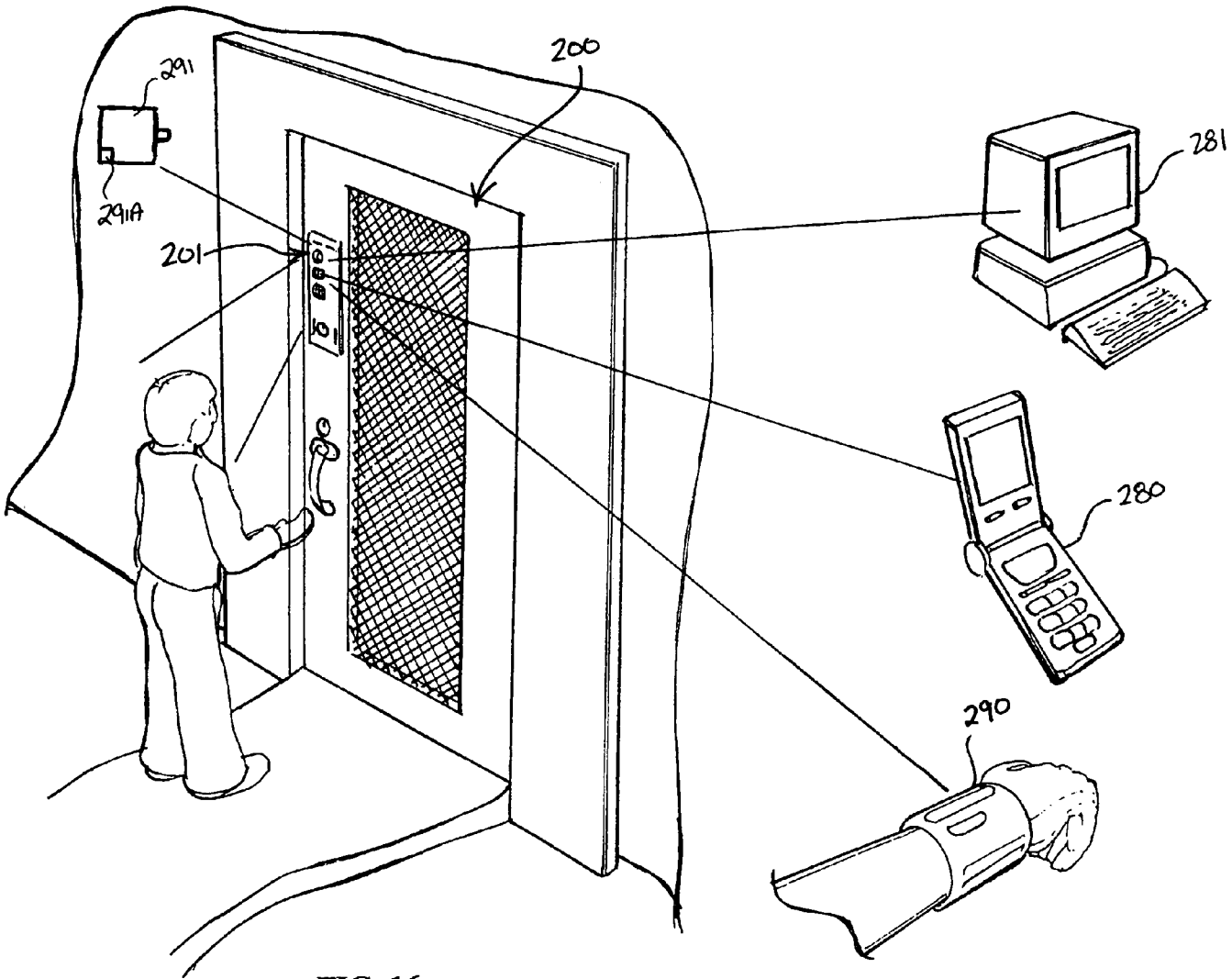
FIG. 16 is a perspective view of the screen unit of FIG. 11 shown installed relative to a dwelling and a plurality of remote devices depicted schematically coupled in signal communication with the security device.

Reference is now made to FIG. 11, which is a fragmented, front elevational view of a screen unit 200 formed with a security device 201, constructed and arranged in accordance with the principle of the invention. Screen unit 200 is adapted to be secured at an entry point, such as a doorway or window entry point, and is generally representative of a screen door or window screen, as previously discussed in prior embodiments, consisting a robust mesh 202 having a perimeter 203, and a frame 204 engaging perimeter 203 of mesh 202 supporting and preventing relative movement between frame 204 and mesh 202. Screen unit 200 has opposed sides, including an inner side 205, and an opposed outer side 206 denoted in FIG. 12. Frame 204 has a thickness from inner side 205 to outer side 206. If used as a screen door, screen unit 200 can be mounted so as to slide back-and-forth between open and closed positions, or may, if desired, be mounted for pivotal movement between open and closed positions as illustrated in FIG. 16. Screen unit 200 can be formed with any manner of lock and unlock screen unit 200, and can be furnished with any necessary door hardware and latches as may be required.

Figure 12:
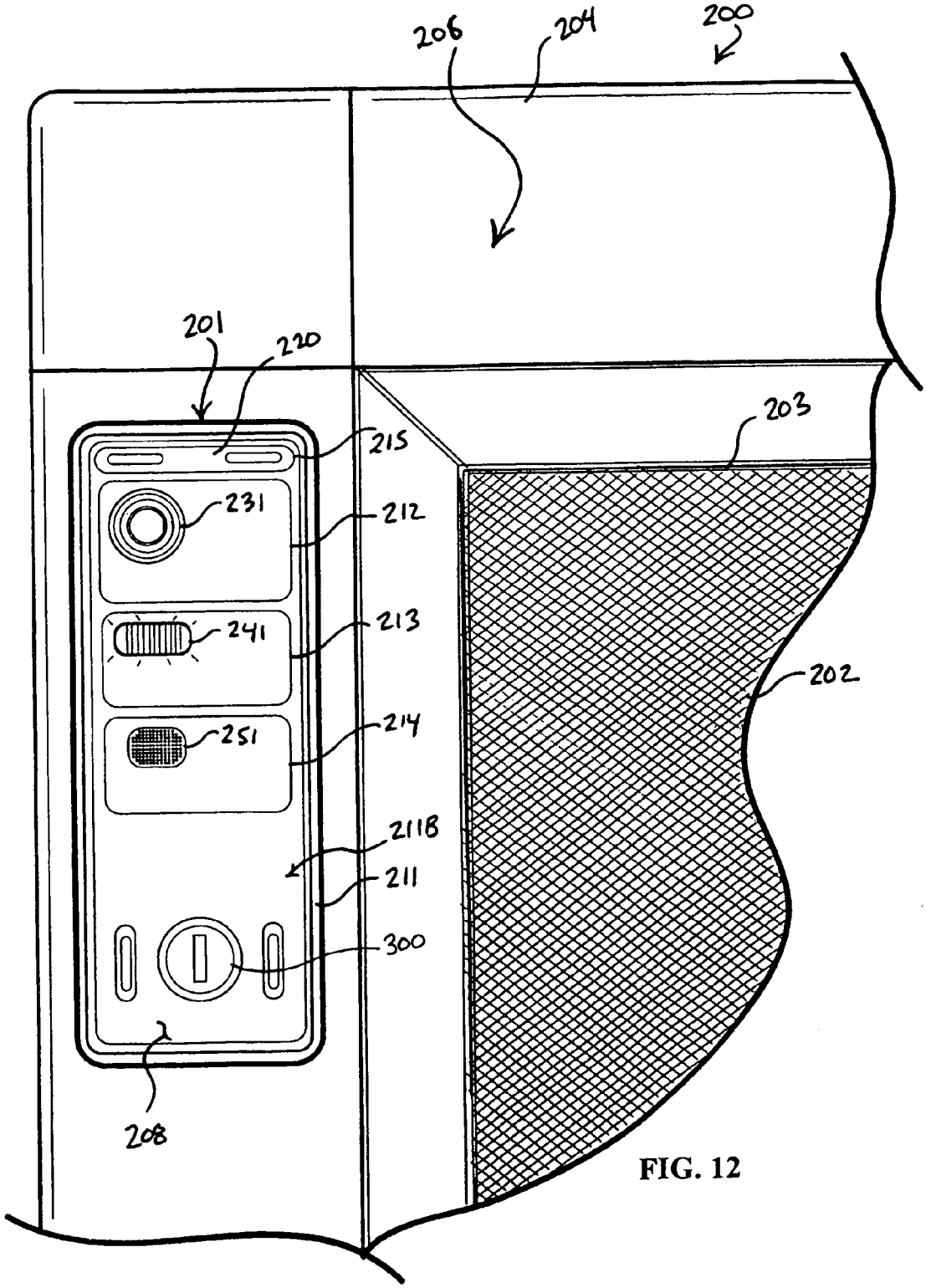
FIG. 12 illustrates a fragmented, rear elevational view of the screen unit formed with the security device of FIG. 11.

Referencing FIGS. 11 and 12, an opening 208 is formed through the thickness of frame 204 within which is formed and retained security device 201. Security device 201 is a self-contained unit, and is powered by an on-board battery power source, by plugging the unit into a power outlet with the use of a power cord, or perhaps by wiring the unit to the electrical wiring in the dwelling or structure. An on-board battery power source incorporated with security device 201 is beneficial to provide security unit with the required backup power in the event the main power provided to security device 201 from the electrically wiring of the dwelling or structure fails. Security device 201 includes a housing 211 supporting and maintaining camera apparatus 212, visual alarm apparatus 213, audible alarm apparatus 214, sensor apparatus 215, remote transmitter 216 coupled to send signals to a wireless network, and low-frequency remote transmitter 217 coupled to issue signals to one or more low-frequency receivers in relatively close proximity to screen unit 200. Sensor apparatus 215 operates to detect unauthorized tampering of screen unit 200, and is operatively coupled to camera apparatus 212, visual alarm apparatus 213, audible alarm apparatus 214, remote transmitter 216, and low-frequency remote transmitter 217. For reference purposes, housing 211 forms an inner side 211A of security device 201 formed along inner side 205 of screen unit 200 formed along frame 204 as illustrated in FIG. 11, and an outer side 211B of security device 201 formed along outer side 206 of security device 201 formed along frame 204 as illustrated in FIG. 12.

Sensor apparatus 215 consists of a sensor 220 to generate an alarm signal in response to unauthorized tampering of screen unit 200, and a plurality of such sensors may be employed if so desired. Sensor 220 senses movement of screen unit 200 that would be reflective of tampering. Sensor 220 may be of the motion detection type, the type that breaks a circuit upon movement of screen unit 200, a magnetic type or contact type to generate a signal upon disturbance of screen unit 200, or the like. All of such sensors are readily commercially available.

Sensor apparatus 215 may be hard wired to camera apparatus 212, visual alarm apparatus 213, audible alarm apparatus 214, remote transmitter 216, and low-frequency remote transmitter 217, or wirelessly coupled to camera apparatus 212, visual alarm apparatus 213, audible alarm apparatus 214, remote transmitter 216, and low-frequency remote transmitter 217. In the latter example, sensor apparatus 215 may emit a low power radio frequency (RF) or infrared (IR) frequency signal upon activation, which signal is sensed by a receiver in security device 201, or perhaps by a remote receiver operative coupled to a camera or light source or siren or the like. Upon activation of sensor apparatus 215 due to unauthorized movement (or tampering) of screen unit 200, camera apparatus 212 is activated, visual alarm apparatus 213 is activated, audible alarm apparatus 214 is activated, remote transmitter 216 is activated, and/or low-frequency remote transmitter 217 is activated.

In accordance with the principle of the invention, camera apparatus 212 consists of an inside camera 230 (FIG. 13) formed along inner side 211A of security device 201 formed along inner side 205 of screen unit 200 formed along frame 204 as illustrated in FIG. 11, an outside camera 231 formed along outer side 211B of security device 201 formed along outer side 206 of screen unit 200 formed along frame 204 as illustrated in FIG. 12, and on/off switch 232 formed along inner side 211A of security device 201 formed along inner side 205 of screen unit 200 formed along frame 204 as illustrated in FIG. 11. On/off switch 232 is used to activate/arm and deactivate/disarm inside and outside cameras 230 and 231 of camera apparatus 212, and is accessible only from inner side 205 of screen unit 200 thereby preventing an unauthorized party from operating camera apparatus 212 of security device 201 from outer side 206 of screen unit 200 and, moreover, from outer side 211B of security device 201. Inside camera 230 operates to take visual or photographic imagery, such as still photographic imagery or video photographic imagery, from inner side 205 of screen unit 200 and from inner side 211A of security device 201, and outside camera 231 operates to take visual or photographic imagery, such as still photographic imagery or video photographic imagery, from outer side 206 of screen unit 200 and from outer side 211B of security device 200. Inside and outside cameras 230 and 231 are each a conventional digital camera. The photographic imagery, which may be referred to simply as imagery, is intended to encompass any form of imagery captured in any format on any type of storage, medium, or transmittable means.

Figure 15:
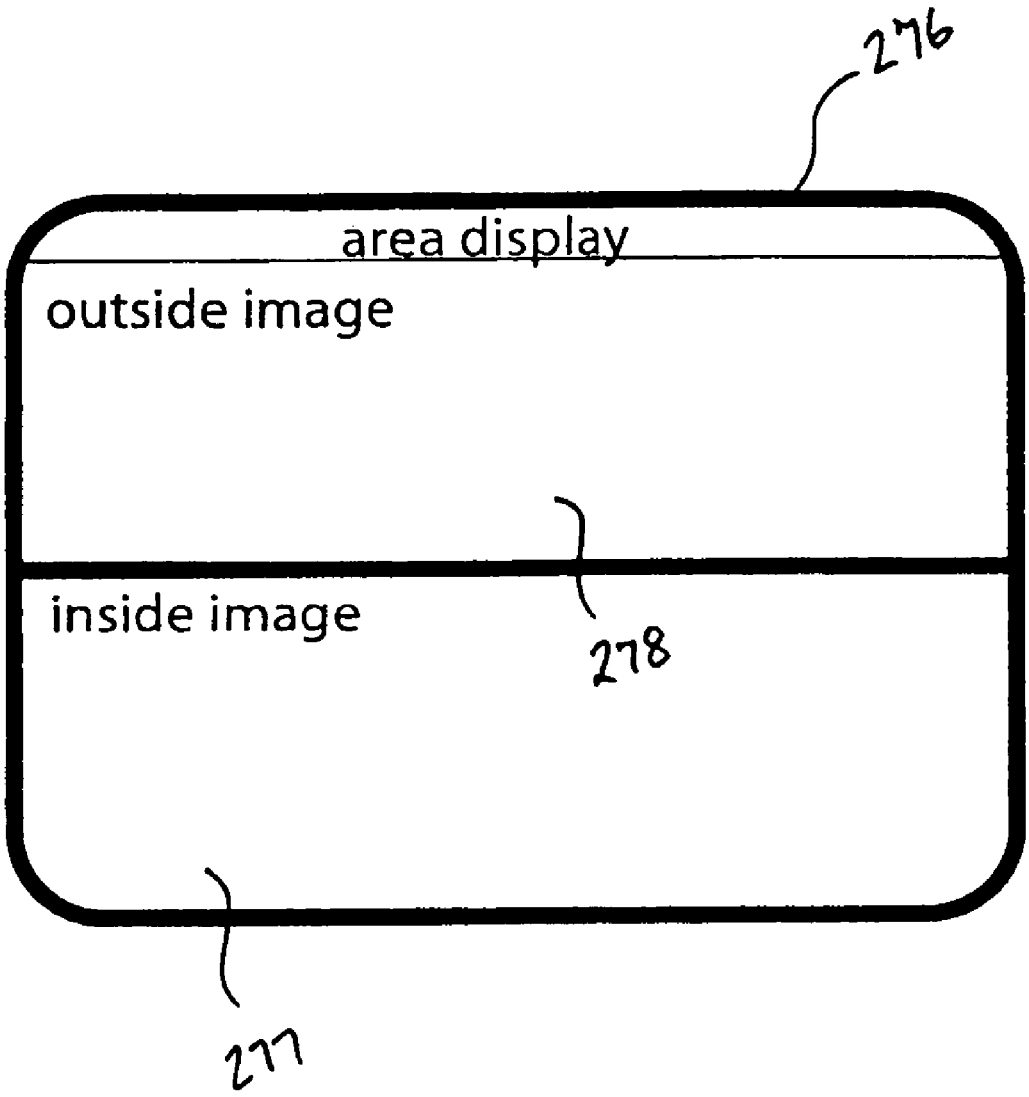
FIG. 15 illustrates a photographic document generated by the security device of FIG. 11.

In a preferred embodiment, photographic imagery taken by camera apparatus 212 consists of a first photographic image taken by inside camera 230 from inner side 205 of screen unit 200, and a second photographic image taken by outside camera 231 from outer side 206 of screen unit 200. Camera apparatus 212 is preferably configured to merge the first and second photographic images in a composition view side-by-side in a photographic document 276 illustrated in FIG. 15, in which the first and second photographic images are denoted at 277 and 278, respectively, thereby providing one document from which the two photographic images may be easily and concurrently viewed. Photographic document 276 is a digitally-formed electronic document, as is normal with a conventional digital camera.

Visual alarm apparatus 213 consists of an inside visual alarm 240 formed along inner side 211A of security device 201 formed along inner side 205 of screen unit 200 formed along frame 204 as illustrated in FIG. 11, an outside visual alarm 241 formed along outer side 211B of security device 201 formed along outer side 206 of screen unit 200 formed along frame 204 as illustrated in FIG. 12, and on/off switch 242 formed along inner side 211A of security device 201 formed along inner side 205 of screen unit 200 formed along frame 204 as illustrated in FIG. 11. On/off switch 242 is used to activate/arm and deactivate/disarm inside and outside visual alarms 240 and 241 of visual alarm apparatus 213, and is accessible only from inner side 205 of screen unit 200 thereby preventing an unauthorized party from operating visual alarm apparatus 213 of security device 201 from outer side 206 of screen unit 200 and, moreover, from outer side 211B of security device 201. Inside visual alarm 240 operates to issue visual alarm stimulus from inner side 205 of screen unit 200 and from inner side 211A of security device 201, and outside visual alarm 241 operates to issue visual alarm stimulus from outer side 206 of screen unit 200 and from outer side 211B of security device 200. Inside and outside visual alarms 240 and 241 are each at least one light source or light, in which the visual alarm stimulus consists of light stimulus, such as bright light, bright blinking light or light formed in some other designated pattern. Preferably, visual alarms 240 and 241 are light-emitting diodes or other similar light form.

Audible alarm apparatus 214 consists of an inside audible alarm 250 formed along inner side 211A of security device 201 formed along inner side 205 of screen unit 200 formed along frame 204 as illustrated in FIG. 11, an outside audible alarm 251 formed along outer side 211B of security device 201 formed along outer side 206 of screen unit 200 formed along frame 204 as illustrated in FIG. 12, and on/off switch 252 formed along inner side 211A of security device 201 formed along inner side 205 of screen unit 200 formed along frame 204 as illustrated in FIG. 11. On/off switch 252 is used to activate and deactivate inside and outside audible alarms 250 and 251 of audible alarm apparatus 214, and is accessible only from inner side 205 of screen unit 200 thereby preventing an unauthorized party from operating audible apparatus 214 of security device 201 from outer side 206 of screen unit 200 and, moreover, from outer side 211B of security device 201.

Inside audible alarm 250 operates to issue audible alarm stimulus from inner side 205 of screen unit 200 and from inner side 211A of security device 201, and outside audible alarm 251 operates to issue audible alarm stimulus from outer side 206 of screen unit 200 and from outer side 211B of security device 200. Inside and outside audible alarms 250 and 251 are each one or more speakers, in which the audible alarm stimulus consists of loud siren type sound or other form of loud or shrill audible alarm type sound.

As indicated above, on/off switch 232 is used to activate/arm and deactivate/disarm camera apparatus 212, on/off switch 242 is use to activate/arm and deactivate/disarm visual alarm apparatus 213, and on/off switch 252 is used to activate/arm and deactivate/disarm audible alarm apparatus 214. Security device 201 is also formed with a main on/off switch 260 formed along inner side 211A of security device 201 formed along inner side 205 of screen unit 200 formed along frame 204 as illustrated in FIG. 11. On/off switch 260 is used to activate/arm and deactivate/disarm switches 232, 242, and 252, and, like switches 232, 242, and 252, is accessible only from inner side 205 of screen unit 200 thereby preventing an unauthorized party from operating security device 201 from outer side 206 of screen unit 200 and, moreover, from outer side 211B of security device 201. When on/off switch 260 is in an "off" position, switches 232, 242, and 252 are inoperative in accordance with the principle of the invention. When on/off switch 260 is in an "on" position, switches 232, 242, and 252 may each be used to activate/arm and deactivate/disarm their respective devices, in accordance with the principle of the invention.

In the use of security device 201, switch 260 is moved into the "on" position activating/arming security device 201 arming sensor apparatus 215. To utilize security device 201 in conjunction with camera apparatus 212, switch 232 is moved into the "on" position activating/arming camera apparatus 212. In response to sensor apparatus 215 detecting unauthorized tampering of screen unit 200 camera apparatus 212 is responsive and operates to collect visual imagery from each of the inner and outer sides 205 and 206 of screen unit 200 to provide an image of any individual on either side of screen unit 200 engaged in unauthorized use or tampering of screen unit 200, in accordance with the principle of the invention, such as an intruder on outer side 206 of screen unit 200 or, for instance, an infant or small child on inner side 205 of screen unit.

If desired, a camera apparatus, like that of camera apparatus 212 or other selected camera device, may be coupled remotely to security device with a conventional transmitter/receiver system. In this permutation of the invention, the camera apparatus or selected camera device can be positioned at any selected position as may be desired for taking imagery of a selected location. In response to sensor apparatus 215 detecting unauthorized tampering of screen unit 200 camera apparatus 212 is responsive, issues a signal to the remote camera apparatus or selected camera device causing it to take photographic imagery, in accordance with the principle of the invention.

To utilize security device 201 in conjunction with visual alarm apparatus 213, switch 242 is moved into the "on" position activating/arming visual alarm apparatus 213. In response to sensor apparatus 215 detecting unauthorized tampering of screen unit 200 visual alarm apparatus 213 is responsive to issue visual alarm stimulus from each of inner and outer sides 205 and 206 of screen unit thereby providing illumination directed away from inner side 205 of screen unit 200 and providing illumination directed away from outer side 206 of screen unit 200 so as to deter the unauthorized use or tampering of screen unit 200.

To utilize security device 201 in conjunction with audible alarm apparatus 214, switch 252 is moved into the "on" position activating/arming audible alarm apparatus 214. In response to sensor apparatus 215 detecting unauthorized tampering of screen unit 200 audible alarm apparatus 214 is responsive to issue audible alarm stimulus from each of inner and outer sides 205 and 206 of screen unit thereby providing an audible alarm directed away from inner side 205 of screen unit 200 and providing an audible alarm directed away from outer side 206 of screen unit 200 so as to deter the unauthorized use or tampering of screen unit 200.

Figure 13:
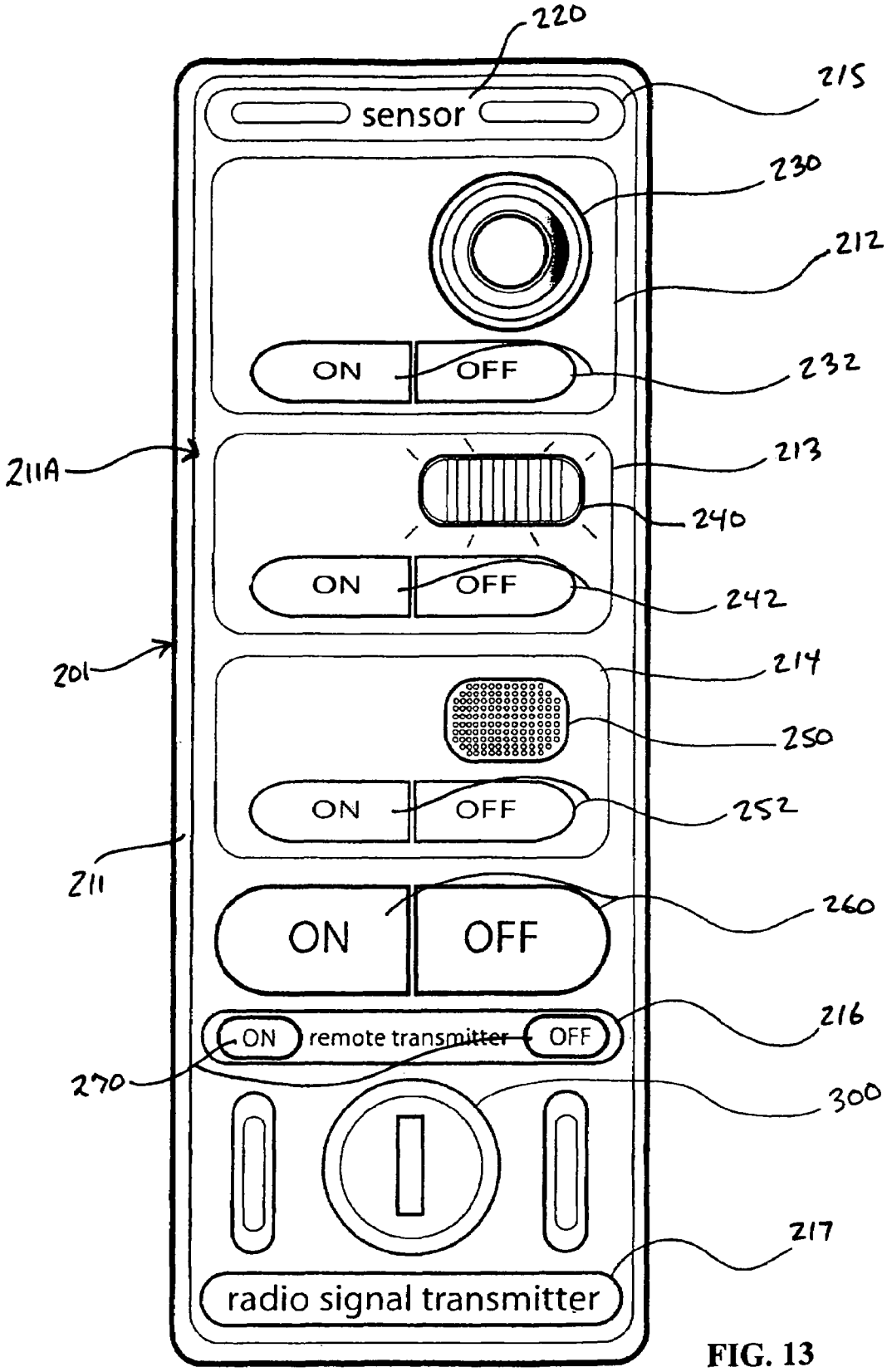
FIG. 13 is an enlarged front elevational view of the security device of FIG. 11.
Figure 14:
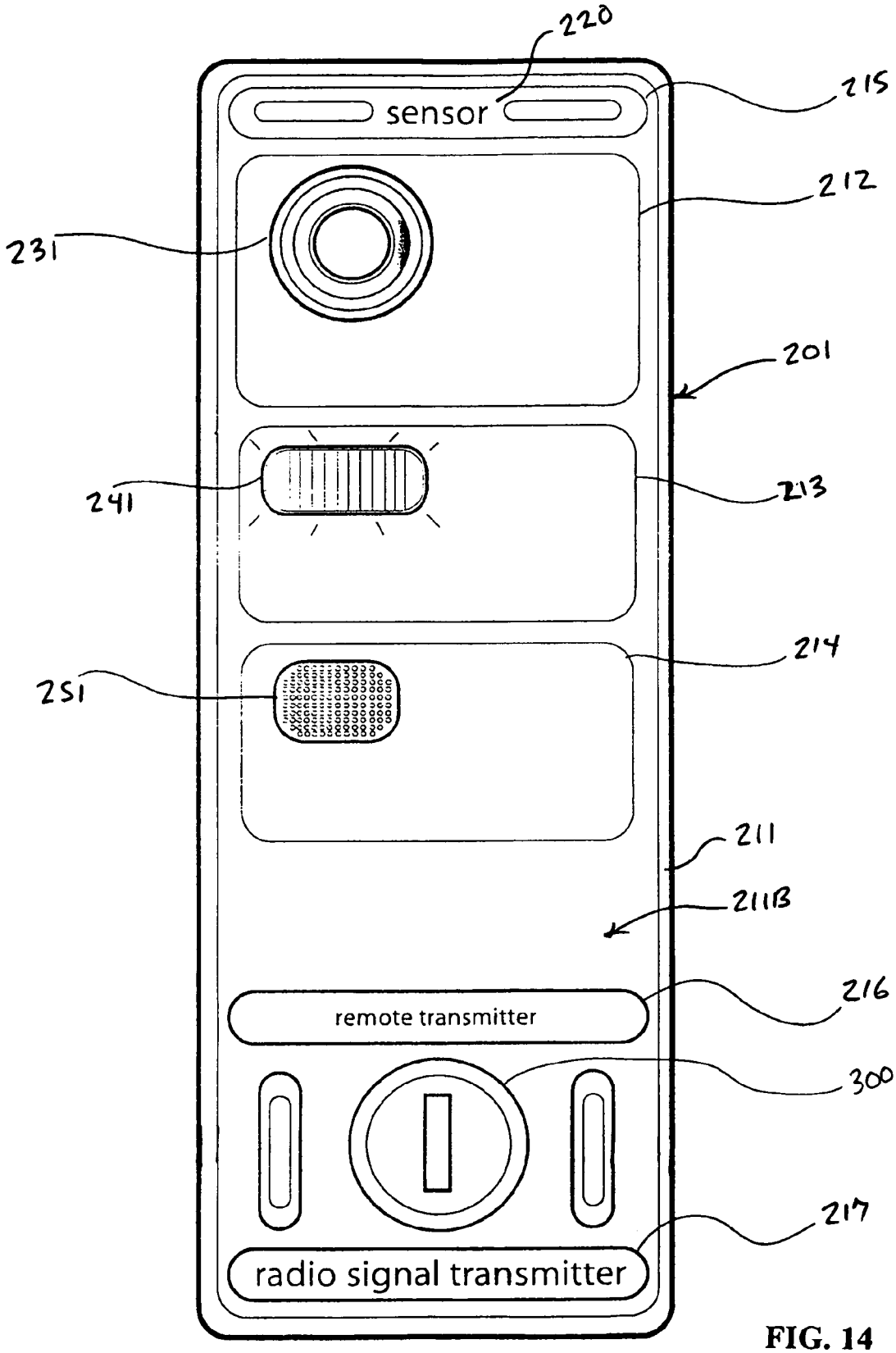
FIG. 14 is an enlarged rear elevational view of the security device of FIG. 11.

Security device 201 is also operational in conjunction with remote transmitter 216, and low-frequency remote transmitter 217. Remote transmitter 216 is a cellular device or appliance to issue a cellular message across a cellular network, or networked internet device or appliance to issue a networked message or computer-based message across a computer network, such as an Internet, that couples security device 201 in signal communication with a remote device, such as a cellular telephonic device 280 to receive cellular messages from remote transmitter 216, such as a cellular phone or pager or the like, and/or a networked internet appliance, such as a networked individual subscriber unit, a computer 281, etc., as referenced in FIG. 16, to receive networked messages from remote transmitter 216. An on/off switch 270 formed along inner side 211A of security device 201 is formed along inner side 205 of screen unit 200 formed along frame 204 as illustrated in FIG. 13. On/off switch 270 is used to activate and deactivate remote transmitter 216, and is accessible only from inner side 205 of screen unit 200 thereby preventing an unauthorized party from operating remote transmitter 216 from outer side 206 of screen unit 200 and, moreover, from outer side 211B of security device 201. In response to sensor apparatus 215 detecting unauthorized tampering of screen unit 200 remote transmitter 216 is responsive to issue a message or signal, such as in the form of a call as evidenced by a ringtone or vibration in the corresponding phone, a text message, email, pre-recorded phone message, or other selected signal, to a designated remote device alerting the user thereof of the unauthorized use or tampering of screen unit 200, or perhaps to the communication system of a security firm or organization. In a preferred embodiment, in response to sensor apparatus 215 detecting unauthorized tampering of screen unit 200 camera apparatus 212 is responsive and operates to collect visual imagery from each of the inner and outer sides 205 and 206 of screen unit 200 to provide photographic document 276 of FIG. 15, and remote transmitter 216 is, in turn, responsive to issue a message, containing photographic document 276, to the designated remote device over the wireless network, whether a wireless cellular network or other network.

Low-frequency remote transmitter 217 is a radio frequency or infrared frequency transmitter or the like and is coupled in signal communication to a remote device to activate the remote device. An example of a remote device is remote device 290 illustrated in FIG. 16, which, in this instance, is a wrist band to be worn by a user in the proximity of the dwelling in which screen unit 200 is used. In response to sensor apparatus 215 detecting unauthorized tampering of screen unit 200 low-frequency remote transmitter 217 is responsive to issue a signal to remote device 290 to alert the user thereof, such as by way of a light, sound, text message, and/or vibration, or other alarm stimulus, of the unauthorized use or tampering of screen unit 200. Remote device 290 is a receiver, such as radio frequency receiver or infrared frequency receiver, or the like, coupled to receive signals from low-frequency transmitter 217. Another remote device 291 is illustrated in FIG. 16, which is a camera, such as a conventional digital camera operative to take still and/or video imagery, which incorporates a corresponding receiver 291A remotely coupled to low-frequency transmitter 217. Receiver 291A, which can be a radio frequency receiver or infrared frequency receiver, or the like, is coupled to receive signals from low-frequency transmitter 217 and is operatively coupled to camera 291 and activates camera 291 to take visual or photographic imagery of a selected venue in response to receiver 291A receiving a signal from low-frequency transmitter 217. Camera 291 can be positioned anywhere as may be desired to take visual or photographic imagery of whatever selected venue one may desire. Low-frequency transmitter 217 may be its own dedicated ON/OFF switch, if desired.

Switches 232, 242, 252, and 270 provide flexibility and allow a user to, when switch 260 is "on" activating/arming security device 201, to use as desired any one or more of camera apparatus 212, visual alarm apparatus 213, audible alarm apparatus 214, and remote transmitter 216. If desired, low-frequency remote transmitter 217 may be furnished with an associated on/off switch used to activate/arm and deactivate/disarm switch 260. Further, low-frequency remote transmitter 217 may be furnished with on/off switches used to activate/arm and deactivate/disarm each of switches 232, 242, 252, and 270. In a particular embodiment, a keypad or the like can be coupled to security device 201, whether hard wired or wirelessly, and used to activate/arm and deactivate/disarm security device 201 in response to entry of a preprogrammed password, such as a numerical password, alphanumerical password, alphabetical password, etc.

Security device 201 may, if desired, be coupled in communication, such as with the use of remote transmitter 216, with a security company or vendor such that such a party may communicate with security device 201 for operating as needed or required, or for facilitating communication with a customer via security device 201. Also, security device 201 may be coupled in signal communication with a remote control device to allow a party to remotely control security device 201 as needed or desired.

Security device 201 can be located anywhere along frame 204. If desired, security device 201 may be fashioned with a key-operated door latch 300, illustrated in FIGS. 11-14, for locking and unlocking screen device 201 relative to an entryway or doorway. Furthermore, all of the other features described above with respect to FIGS. 1-8 may be incorporated in the screen unit discussed in conjunction with FIGS. 11-16. If desired, a robust security enclosure or cage can be formed about security device 201 to prevent unauthorized access to security device 201 and to prevent an intruder from damaging security device 201.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus, comprising:

a screen unit adapted to be secured at an entry point, the screen unit having opposed sides;

a security device formed in the screen unit, the security device including sensor apparatus to detect unauthorized tampering of the screen unit, and camera apparatus operatively coupled to the sensor apparatus;

in response to the sensor apparatus detecting unauthorized tampering of the screen unit the camera apparatus to collect visual imagery from each of the sides of the screen unit;

the visual imagery comprises a first photographic image taken by the camera apparatus from the first side of the screen unit, and a second photographic image taken by the camera apparatus from the second side of the screen unit; and the first and second photographic images are situated side-by-side in a photographic document.

2. Apparatus according to claim 1, further comprising:

the security device further including an audible alarm apparatus operatively coupled to the sensor apparatus; and in response to the sensor apparatus detecting unauthorized tampering of the screen unit the audible alarm apparatus to issue audible alarm stimulus on each of the sides of the security device.

3. Apparatus according to claim 1, further comprising:

the security device further including visual alarm apparatus operatively coupled to the sensor apparatus; and in response to the sensor apparatus detecting unauthorized tampering of the screen unit the visual alarm to issue visual alarm stimulus on each of the sides of the screen unit.

4. Apparatus according to claim 1, further comprising:

the security device coupled in wireless signal communication to a device; and the security device to issue the visual imagery to be wirelessly received by the device.

5. Apparatus, comprising:

a screen unit adapted to be secured at an entry point, the screen unit having opposed sides;

sensor apparatus to detect unauthorized tampering of the screen unit;

camera apparatus operatively coupled to the sensor apparatus;

in response to the sensor apparatus detecting unauthorized tampering of the screen unit the camera apparatus to collect visual imagery from each of the sides of the screen unit;

the visual imagery comprises a first photographic image taken by the camera apparatus from the first side of the screen unit, and a second photographic image taken by the camera apparatus from the second side of the screen unit; and the first and second photographic images are situated side-by-side in a photographic document.

6. Apparatus according to claim 5, further comprising:

audible alarm apparatus operatively coupled to the sensor apparatus; and in response to the sensor apparatus detecting unauthorized tampering of the screen unit the audible alarm apparatus to issue audible alarm stimulus.

7. Apparatus according to claim 5, further comprising:

visual alarm apparatus operatively coupled to the sensor apparatus; and in response to the sensor apparatus detecting unauthorized tampering of the screen unit the visual alarm to is sue visual alarm stimulus.

8. Apparatus according to claim 5, further comprising:

the security device coupled in wireless signal communication to a device; and the security device to issue the visual imagery to be wirelessly received by the device.

* * * * *